United States Patent [19]

Matheson et al.

[11] Patent Number: 4,654,760

[45] Date of Patent: Mar. 31, 1987

[54] FUSION SEALED GLASS LAMP UNIT

[75] Inventors: Robert R. Matheson, Euclid; Denes Tarnay, Cleveland; Peter Kolenich, Mahoning, all of Ohio

[73] Assignee: General Electric Company, Schenectady, N.Y.

[21] Appl. No.: 804,553

[22] Filed: Dec. 4, 1985

[51] Int. Cl.[4] ..... F21V 29/00

[52] U.S. Cl. ..... 362/80; 362/267

[58] Field of Search ..... 362/267, 306, 80, 83, 362/61, 310, 311

[56] References Cited

U.S. PATENT DOCUMENTS 4,128,864 12/1978 Brussee et al. ..... 362/306

4,425,606 11/1984 Shanks et al. ..... 362/267

4,451,873 5/1984 Tyler et al. ..... 362/267

4,544,998 10/1985 Shanks ..... 362/267

*Primary Examiner*—William A. Cuchlinski, Jr.

*Assistant Examiner*—D. M. Cox

*Attorney, Agent, or Firm*—J. F. McDevitt; Philip L. Schlamp; Fred Jacob

[57] ABSTRACT

An improved sealing construction is provided for an all glass lamp unit utilizing lens and reflector members which enhances the mechanical strength and hermetic seal when these lamp components are fusion sealed together. Specifically, the sealing rim surfaces of said lamp components are each provided with cooperating and opposing rib elements to permit direct physical abutment therebetween and thereby avoid forming void spaces in the sealing rim region when the fusion seal is made.

1 Claim, 2 Drawing Figures

FUSION SEALED GLASS LAMP UNIT

BACKGROUND OF THE INVENTION

Rib elements located on the sealing surfaces of a sealed beam glass lamp unit are known as disclosed in U.S. Pat. No. 4,128,864, which is assigned to the assignee of the present invention, to prevent warpage ordinarily encountered when the pressed glass articles are thermally sealed together to provide a hermetic lamp enclosure. As therein disclosed, undesirable deformation of the lens member component for said pressed glass sealed beam unit is avoided when rib elements projecting rearwardly from the back sealing surfaces of the individual lens and reflector members are utilized. When the longitudinally extending front planar sealing surfaces of said lamp components are fusion sealed together, however, it becomes possible to still form void spaces at the sealing interface resulting in a glass seal that is either mechanically weak or non-hermetic, especially during the heated conditions of lamp operation.

The conventional glass PAR lamp now employs rib elements, commonly called "keys", which project forwardly from the planar sealing surfaces located in the sealing rim region of the lens and reflector members. Said prior art rib elements are located on the outer periphery of the lens member and on the inner periphery of the reflector member to help align the members for proper sealing engagement generally in a vertical position as carried out by the lamp assembly equipment. Unfortunately, such orientation of these alignment rib elements leads to void spaces being formed in the sealing rim region adjacent said rib elements which again produces the type seal defects above explained.

It is an important object of the present invention, therefore, to modify the planar sealing surfaces of a fusion sealed glass lamp unit in a manner avoiding the formation of void spaces in the sealing rim region when said lamp unit is manufactured.

It is another important object of the present invention to modify said planar sealing surfaces on the individual lens and reflector members in such a manner that alignment therebetween when being hand loaded in the customary vertical orientation for heat sealing together on the lamp manufacturing equipment is reported to be more easily accomplished.

SUMMARY OF THE INVENTION

It has now been discovered, surprisingly, that a simple reversal of the above-mentioned prior art keying arrangement located on the front planar sealing surfaces of the individual lens and reflector members effectively prevents voids being formed in the sealing rim region when said lamp components are sealed together at the customary elevated temperatures which melt the glass material. More particularly, the presently fusion sealed glass lamp unit comprises a lens and reflector member with cooperating and opposing sealing rim surfaces characterized by having a rib element protruding forwardly from the inner periphery of the front sealing surface for said lens member which is configured to physically abut with a rib element protruding forwardly from the outer periphery of the front sealing surface for said reflector member so as to avoid forming voids in the sealing rim region when the fusion seal is made. In one preferred embodiment, said improved lamp construction has a circular PAR lamp contour having otherwise flat planar sealing surfaces. In a different preferred embodiment said improved lamp construction can have a substantially polygonal cross section configuration such as the known rectangular shape now commonly employed in automotive headlamps. Both of said lamp units can further employ a lens member which includes optical prism elements and with a detailed description of both lamp type constructions appearing in the aforementioned U.S. Pat. No. 4,128,864 patent which is herein incorporated by reference. As previously mentioned, said referenced prior art lamp construction utilized anti-warp rib elements projecting rearwardly from the back sealing surface of the reflector member to avoid a warp condition when the fusion seal is made. Such projections can advantageously be combined with the forwardly projecting rib elements of the present invention to provide a still more reliable fusion seal of these lamp components.

DESCRIPTION OF THE PREFERRED EMBODIMENTS

Figure 1:
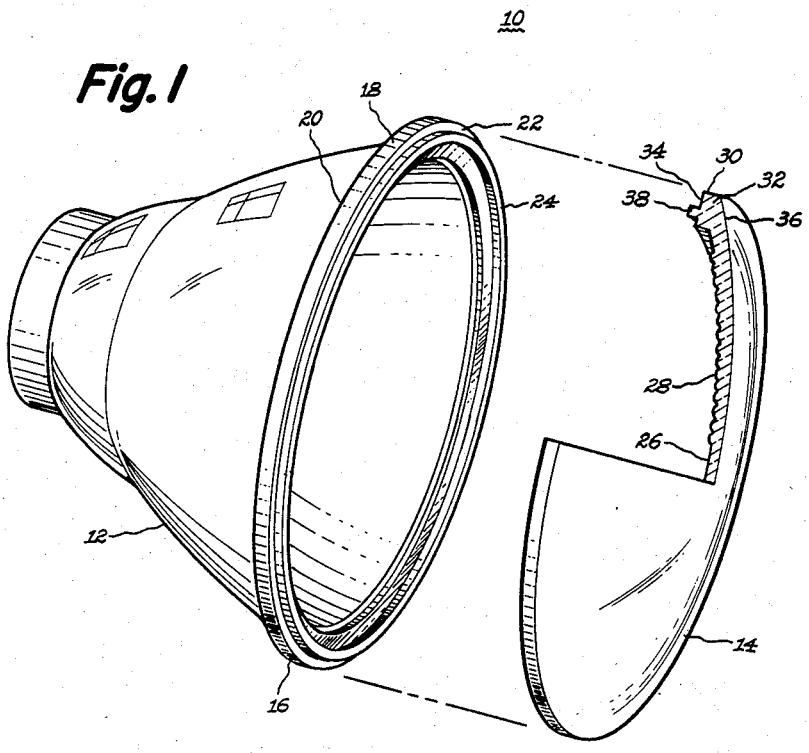
FIG. 1 is a perspective view, partially in cross-section, of an improved circular shaped PAR lamp unit of the present invention prior to heat sealing.

Referring to the drawings, there is shown in FIG. 1, a circular shaped PAR lamp unit 10 which includes a pressed glass parabolic reflector member 12 together with a pressed glass lens member 14 prior to heat sealing together. Said reflector member 12 includes a longitudinally extending sealing rim 16 that is characterized by a body section 18 which terminates in front and back sealing surfaces 20 and 22. Said front sealing surface 22 is of a planar configuration other than having a rib element 24 which projects forwardly and is located at the outer periphery of said longitudinally extending sealing rim. Said glass lens member 14 includes an inner surface 26 having representative prism elements 28 located thereon along with an outer sealing rim 30 for cooperative sealing engagement with the sealing rim 16 of the reflector member. Specifically, said sealing rim configuration 30 includes a body section 32 terminating in front and back sealing surfaces 34 and 36, respectively, and which cooperate in forming the presently improved hermetic seal construction. Said front sealing surface 34 is of a planar shape other than for a forwardly projecting rib element 38 which is located at the inner periphery of said longitudinally extending sealing rim.

Figure 2:
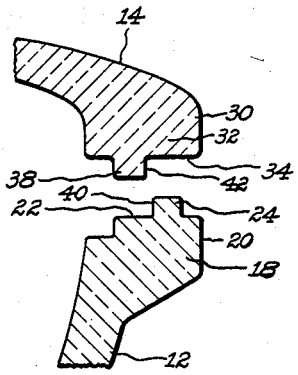
FIG. 2 is a cross-sectional view of the sealing rim region for the lamp unit depicted in the FIG. 1 embodiment which illustrates the projecting rib elements in greater detail.

In FIG. 2 there is shown in cross section, a portion of the sealing rim regions for the above described embodiment after being assembled together in the customary manner to form the fusion seal and which is generally accomplished with a gas flame on conventional lamp manufacturing equipment. Accordingly, the same numerals are employed in said FIG. 2 drawing to identify common structural elements described in the FIG. 1 drawing. It can be noted that the physically assembled but still unsealed lamp unit results in cooperative and opposing engagement of the individual front sealing surfaces 22 and 34 as well as the projecting rib elements 24 and 38. The observed physical engagement permits direct physical abutment between opposing side edges 40 and 42 of said respective rib elements when the fusion sealing operation takes place and thereby enable a final seal being achieved without significant void formation. Surprisingly, such reversed location of the rib or key elements according to the present invention as compared with the prior art keying arrangement has also been found responsible for pressing the individual glass parts with greater dimensional reliability and reduced residual stress.

While a preferred embodiment of the presently improved fusion seal glass lamp unit has been illustrated, various other embodiments will become apparent to persons skilled in the art without departing from the true spirit and scope for the present invention. For example, it will be apparent from the foregoing description that polygonal lamp shapes such as described in the above-referenced U.S. Pat. No. 4,128,864 patent can routinely be modified to incorporate the present improvement at the front sealing surfaces. Accordingly, the scope of the present invention is limited only by the following claims:

We claim:

1. A fusion sealed all glass lamp unit comprising glass lens and reflector members with cooperating and opposing sealing rim surfaces characterized by having a single rib element protruding forwardly from the inner periphery of the otherwise flat planar sealing rim surface for said lens member which is configured to physically abut with a single rib element protruding forwardly from the outer periphery of the otherwise flat planar sealing rim surface for said reflector member so as to avoid forming voids in the sealing rim region when the fusion seal is made to produce a hermetic seal therebetween, and said rib elements being configured so that direct physical abutment occurs between opposing side edges of said rib elements.

* * * * *